US008800675B2

(12) United States Patent
Machado et al.

(10) Patent No.: US 8,800,675 B2
(45) Date of Patent: Aug. 12, 2014

(54) AIRCRAFT FIRE EXTINGUISHING DEVICE AND MOUNTING METHOD

(75) Inventors: Stephane Machado, Villeneuve-Tolosanne (FR); Frederic Rossi, Lartigue (FR); Julien Cayssials, Toulouse (FR); Nicolas Voyer, Toulouse (FR)

(73) Assignee: Airbus Operations SAS, Toulouse (FR)

( * ) Notice: Subject to any disclaimer, the term of this patent is extended or adjusted under 35 U.S.C. 154(b) by 1003 days.

(21) Appl. No.: 12/718,754

(22) Filed: Mar. 5, 2010

(65) Prior Publication Data

US 2010/0230122 A1 Sep. 16, 2010

(30) Foreign Application Priority Data

Mar. 10, 2009 (FR) ..... 09 51481

(51) Int. Cl.
*A62C 25/00* (2006.01)

(52) U.S. Cl.
USPC ..... 169/43; 169/30; 169/53; 239/171; 239/600

(58) Field of Classification Search
USPC ..... 169/30, 53, 62, 71–89, 43; 239/289, 239/171, 600; 248/304, 322, 339–344, 544, 248/558, 645
See application file for complete search history.

(56) References Cited

U.S. PATENT DOCUMENTS 1,182,186 A * 5/1916 McCaslin ..... 169/79
2005/0150663 A1 7/2005 Fabre et al.

FOREIGN PATENT DOCUMENTS

FR 2864905 7/2005

OTHER PUBLICATIONS

French Search Report and Written Opinion dated Sep. 18, 2009.

* cited by examiner

*Primary Examiner* — Christopher Kim
(74) *Attorney, Agent, or Firm* — Greer, Burns & Crain Ltd.

(57) ABSTRACT

A fire extinguisher device for aircraft has a hanger structure and a reservoir of extinguishing agent, the aforementioned reservoir being hung beneath the aforementioned hanger structure by metal fittings held by fasteners to the aforementioned hanger structure. The aforementioned extinguisher wherein the reservoir has means of suspension and the hanger structure has carriers complementary to the means of suspension, the aforementioned means of suspension and the aforementioned carriers being such that when the fasteners are withdrawn, the reservoir is in a position called the "intermediate position," in which the metal fittings are free and the reservoir is suspended by interaction of the means of suspension and the carriers. The disclosed embodiments also relate to a method for fastening such an extinguishing device.

10 Claims, 5 Drawing Sheets

AIRCRAFT FIRE EXTINGUISHING DEVICE AND MOUNTING METHOD

CROSS-REFERENCE TO RELATED APPLICATIONS

This application claims priority to and the benefit of French Application No. 09 51481 filed on 10 Mar. 2009, the disclosures of which are incorporated herein by reference in its entirety.

The aspects of the disclosed embodiments relate to a firefighting device, called an extinguisher. More particularly, the disclosed embodiments relate to a system for installation and removal of reservoirs of extinguishing agent of an aircraft fire extinguisher.

BACKGROUND

In modern airplanes, more particularly civilian transport airplanes, fire extinguishers are provided.

Such devices, known for example from the Application FR 2864905, besides means for detecting the start of a fire and for controlling said device, have one or more reservoirs of extinguishing agent feeding a network to distribute the extinguishing agent to spray nozzles.

The reservoirs of extinguishing agent contain the extinguishing agent itself and means for pressurizing this extinguishing agent inside the reservoir, by means of a propelling agent, to permit its distribution at the desired time.

In practice, the reservoirs of extinguishing agent are often installed close to areas at risk of fire, such as hot zones where fuel circulates in the environment of the engines, or such as areas in which the impossibility of access in flight does not allow any other means of firefighting, for example the cargo compartments.

As an illustration that is particularly suitable for the applications of the disclosed embodiments, the case of an installation of a reservoir of fire extinguishing agent in an engine pylon is considered in the following description.

Thus, in airplanes that have engines attached beneath the wings by suspension pylons, it is beneficial to fasten the extinguishing agent reservoirs of the engine fire extinguishers inside the pylons, despite the numerous systems including cables and pipes passing through inside the pylons, and the size of the pylons which is reduced so as not to penalize the aerodynamics of the airplane.

Also, the extinguishing agent reservoirs must be the object of frequent checks in situ and in the workshop to verify their good condition, the volumes of extinguishing agent and of propelling agent inside them, and to be regularly reconditioned or replaced in case of their use.

Accordingly, the extinguishing agent reservoirs are necessarily capable of being taken down, and to that end, in particular when they are installed in a pylon, they are fastened to a fire extinguisher hanger structure, itself fastened to the inside of the principal structure of the pylon, from where said reservoirs can be removed or introduced through openings made in the side walls of the pylon, which openings are limited to a strict minimum because of the fact that said walls are generally working walls.

An example of a known extinguishing agent reservoir 1 is shown in FIG. 1*a*. An example of a hanger structure 2 is shown in FIG. 1*b* without the other parts of the principal structure of the pylon.

In all of the present description, the references to positioning the various elements are made considering said elements installed in a pylon of an airplane immobile on the ground; this is the case inter alia for the references "lower", "upper", "horizontal", "vertical", etc.

The hanger structure 2 in the pylon structure occupies principally a space located above the reservoirs 1.

The hanger structure 2 has an essentially horizontal chassis 20, beneath which are fastened a plurality of longitudinal crossbars 21. Each of said crossbars 21 has an essentially horizontal lower edge, and a reservoir 1 is fastened on the lower bearing surfaces of said lower edges of two adjacent crossbars 21.

A rail 22 is associated with each of said crossbars and forms a lateral guide beneath the crossbar 21 with which it is associated, which extends along said crossbar. For each pair of adjacent crossbars 21, two facing lateral slider bars are thus formed.

The extinguishing agent reservoir 1 has four metal fittings 10 intended to be fastened by fasteners, such as screws and nuts, to the lower bearing surfaces of the crossbars 21 of the hanger structure 2, which are positioned on the upper spherical head of the reservoir 1.

Each fitting 10 protrudes laterally on said upper spherical head, and has an edge forming a tenon, whose shape and dimensions are suitable for permitting said edge to slide in a lateral guide of the hanger structure 2. Each fitting 10 has an upper support bearing surface that is essentially planar and horizontal, to lean against the lower bearing surface of a crossbar 21 of the hanger structure 2.

As shown in FIG. 1*c*, each reservoir 1 is installed beneath the hanger structure 2 by engaging the edges of the metal fittings 10 in the facing lateral guides of a pair of adjacent crossbars 21. Said edges are placed onto the rails 22 of said lateral guides, and slide on said rails to penetrate into said engine pylon.

However, the engagement of the edges of the fittings 10 in the lateral guides to place the reservoir in the pylon is not easy, because of the dimensions of the openings made in the side walls of the pylon. The assembly is also not easy because such a reservoir 1 is generally rather voluminous (diameter of the order of 30 centimeters) and heavy (weight greater than 20 kilograms), and has to be carried at arm's length by one or more operators during its installation in the inside restricted space of the pylon.

It can be understood that new means are necessary to facilitate installation and removal of airplane fire extinguisher reservoirs.

SUMMARY

The disclosed embodiments propose to solve the aforementioned problems by means of an extinguisher that comprises a hanger structure and at least one extinguishing agent reservoir, with the reservoir being hung beneath the hanger structure by fittings held by fasteners to said hanger structure. According to the disclosed embodiments, the reservoir comprises means of suspension, and the hanger structure comprises complementary carriers for the means of suspension, with the means of suspension and the carriers being such that:

when the fasteners are tightened, the reservoir is in a position, called the "operational position", in which the fittings are integral with the hanger structure and the means of suspension and the carriers are engaged without contact, when the fasteners are taken out, the reservoir is in a position, called the "intermediate position", in which the fittings are free and the reservoir is suspended by interaction between the means of suspension and the carriers.

The means of suspension are preferably made in an upper part of the reservoir, essentially in a position vertical from a center of gravity of the reservoir. The means of suspension and the carriers are preferably made so that the intermediate position is adjacent to the operational position.

In a preferred embodiment, the means of suspension comprise a free end in the form of a hook, preferably associated with carriers that comprise a ring.

In another preferred embodiment, the means of suspension comprise a free end with a T-shaped cross section, preferably associated with carriers that comprise a longitudinal guide.

The means of suspension advantageously comprise only one free end.

According to the disclosed embodiments, a procedure for fastening a reservoir of extinguishing agent of such an extinguisher includes the following steps:

a step of suspending the reservoir on the hanger structure during which the means of suspension of the reservoir are engaged in the carriers of the hanger structure and interact with said carriers so that the reservoir is in an intermediate suspended position in which the metal fittings are free, a step of fastening the reservoir beneath the hanger structure in which the fittings of the reservoir are fastened to the hanger structure by tightening the fasteners.

BRIEF DESCRIPTION OF THE DRAWINGS

The following description of examples of the disclosed embodiments is given with reference to the drawings, in which identical references designate identical or analogous elements, which show in a non-limiting way.

DETAILED DESCRIPTION

The disclosed embodiments are applicable to any fire extinguisher for aircraft, more particularly extinguishers lodged in areas of the aircraft that are inaccessible in flight, such as engine fire extinguishers or cargo compartment fire extinguishers.

Figure 4:
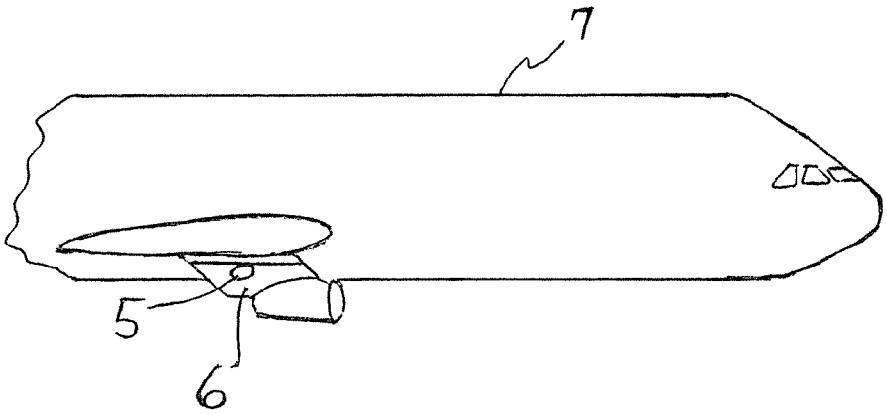
FIG. 4: a schematic representation illustrating the installation of the reservoir in a pylon of an aircraft.

The non-limiting case of an extinguisher 5 intended to be fastened in an engine pylon 5 of an airplane 7 (shown in FIG. 4) is considered for the needs of the description of embodiments of the disclosed embodiments.

According to the disclosed embodiments, an extinguisher has at least one reservoir 3 for extinguishing agent and a hanger structure 4 intended to be fastened to the inside of a principal structure of an engine pylon.

The extinguishing agent reservoir 3, for example, has an essentially spherical shape and has metal fittings 300, 301*a*, 301*b* intended to be integrated with the hanger structure 4 by fasteners.

For the needs of the description, a frame of reference with three axes X, Y, and Z, is associated with the extinguisher:

the Z axis is essentially vertical and points upward when the extinguisher is installed in an airplane immobile on the ground, the Y axis is perpendicular to the Z axis and is oriented in a longitudinal direction along which the reservoir 3 is inserted into the hanger structure 4, the X axis is perpendicular to the Y and Z axes and forms a plane with the Y axis that is considered to be essentially horizontal when the extinguisher is installed in an airplane immobile on the ground.

The hanger structure 4 according to the disclosed embodiments has a chassis 40, essentially horizontal in the non-limiting examples shown in the Figures, and other elements described below to which the metal fittings 300, 301*a*, 301*b* of the reservoir 3 are fastened by fasteners, not shown.

The position of the reservoir 3 when it is fastened to the hanger structure 4 is called the "operational position."

According to the disclosed embodiments, the reservoir 3 has means of suspension 31 and the hanger structure 4 has carriers 41 complementary to said means of suspension.

The means of suspension 31 of the reservoir 3, when they interact with the carriers 41 of the hanger structure 4, permit said reservoir to be suspended on said hanger structure in a position called the "intermediate position," in which the metal fittings 300, 301*a*, 301*b* are free and do not transmit any forces to said hanger structure.

In a preferred embodiment, the means of suspension 31 of the reservoir 3 extends essentially vertically from the upper spherical head of the reservoir 3 and have a free end 31*a* with a T-shaped cross section in a plane parallel to an XZ plane containing the X and Z axes, with said free end 31*a* being in a position essentially vertical from the center of gravity of the reservoir 3.

Figure 2A:
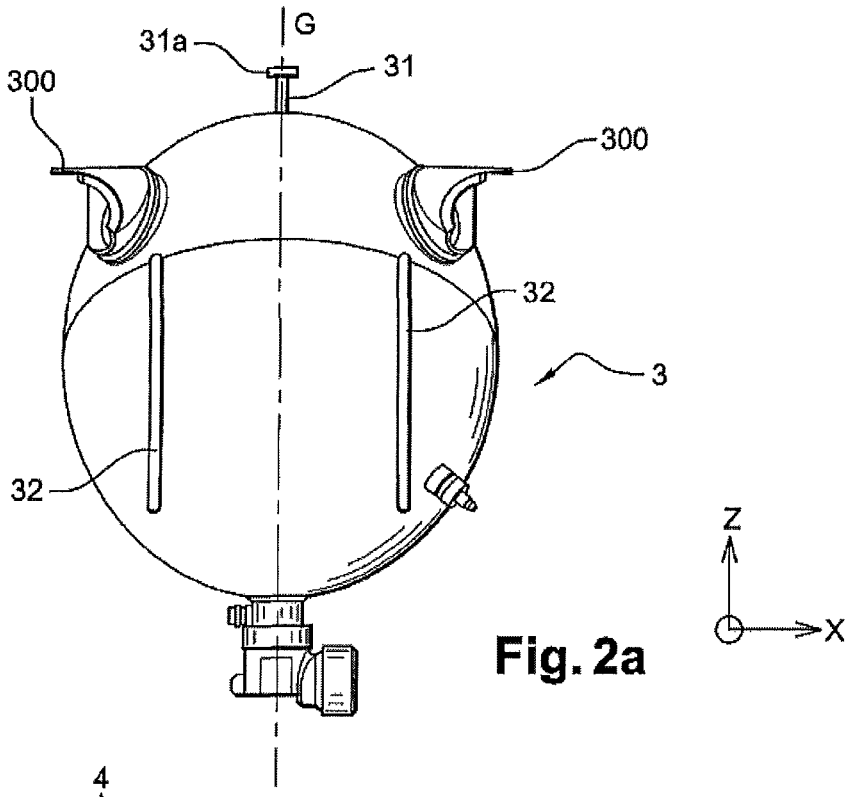
FIGS. 2*b* and 2*c*: two schematic representations in perspective, illustrating the installation of the reservoir of FIG. 2*a* in a hanger structure according to the disclosed embodiments.

In the non-limiting example shown in FIG. 2*a*, the means of suspension 31 extends between said free end 31*a* and an end integral with the upper spherical head of the reservoir 3, along an axis G passing through the center of gravity of said reservoir and parallel to the Z axis.

More generally, it is necessary for the width of the free end 31*a*, measured along the X axis, to assume two values along the G axis, called the "small width" and the "large width", with said small width being on the side of the end integral with the reservoir 3, and said large width being on the side opposite said reservoir.

Figure 2B:
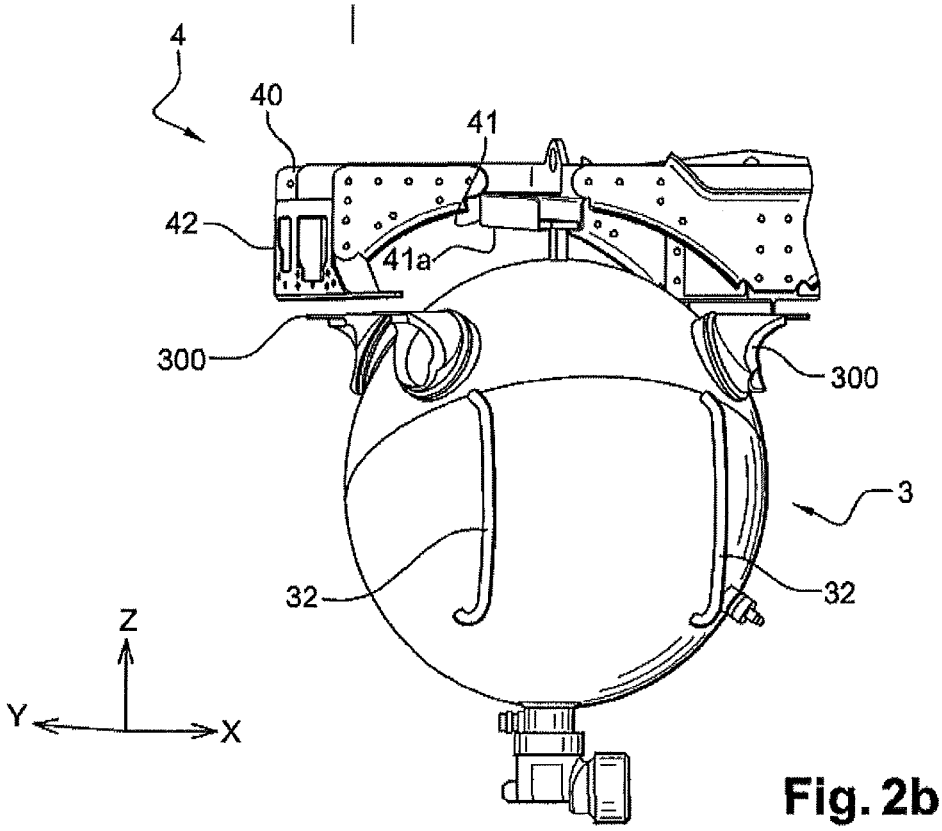
Figure 2C:
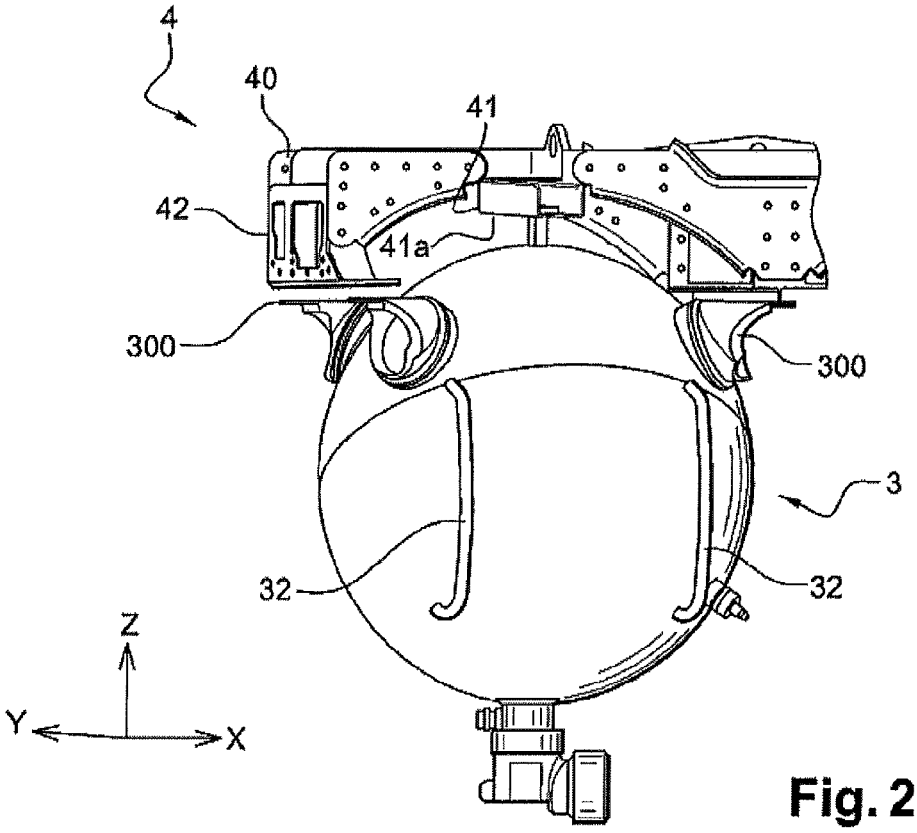

The carriers 41 of the hanger structure 4, complementary to the means of suspension 31 with a T-shaped free end 31*a* has a longitudinal guide 41*a* in the example shown, securely fastened beneath the chassis 40, visible in FIGS. 2*b* and 2*c*.

The guide 41*a* is a principally hollow element with an internal width measured along the X axis larger than the large width of the free T-shaped end 31*a* of the means of suspension 31, which has a horizontal groove in its lower part whose width is greater than the small width of the T-shaped free end 31*a* and smaller than the large width of said free end.

As shown in FIG. 2*b* and FIG. 2*c*, the guide 41*a* is open at one end through which the free T-shaped end 31*a* penetrates into the guide by moving along the direction of the Y axis. When the T-shaped free end 31*a* is engaged in the guide 41*a*, the reservoir 3 is suspended on the hanger structure 4 because the width of the groove is smaller than the large width of said free end, and said reservoir can slide along said guide.

The structural characteristics of the guide 41*a* and of the linkage of said guide with the chassis 40 are defined to assure sufficient mechanical strength to support the weight of the reservoir 3 filled with extinguishing agent and propelling agent.

The position of the guide 41*a* beneath the chassis 40 is such that an intermediate position of the reservoir 3 adjacent to the desired operational position can be obtained by said reservoir moving along said guide.

"Intermediate position adjacent to the operational position" means that the motions necessary to pass from one to the other have a maximum amplitude of the order of several centimeters, and preferably of the order of one centimeter or less.

Figure 1A:
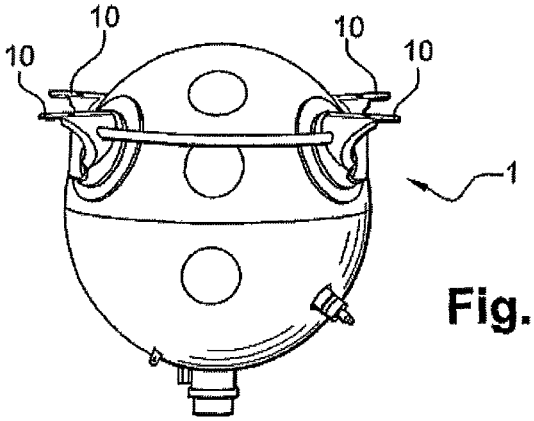
FIG. 1*a*: already cited, a reservoir pursuant to the prior art.
Figure 1B:
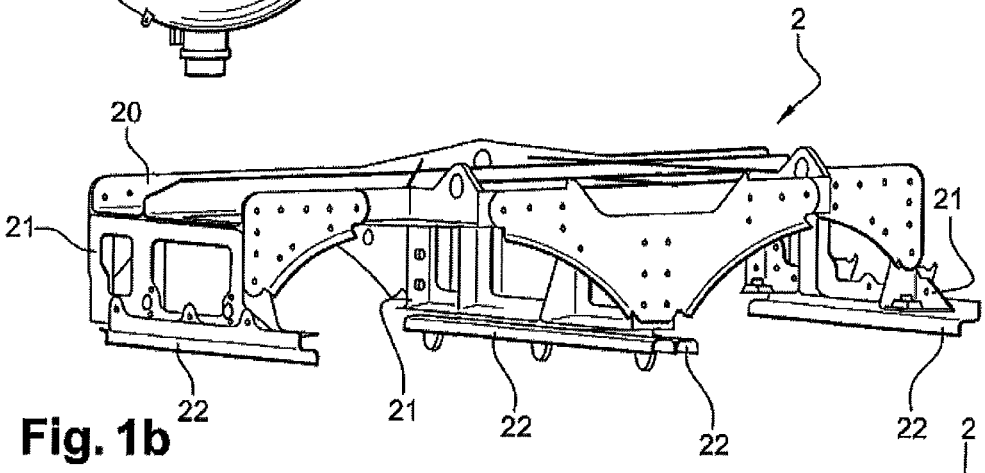
FIG. 1*b*: already cited, a hanger structure pursuant to the prior art.
Figure 1C:
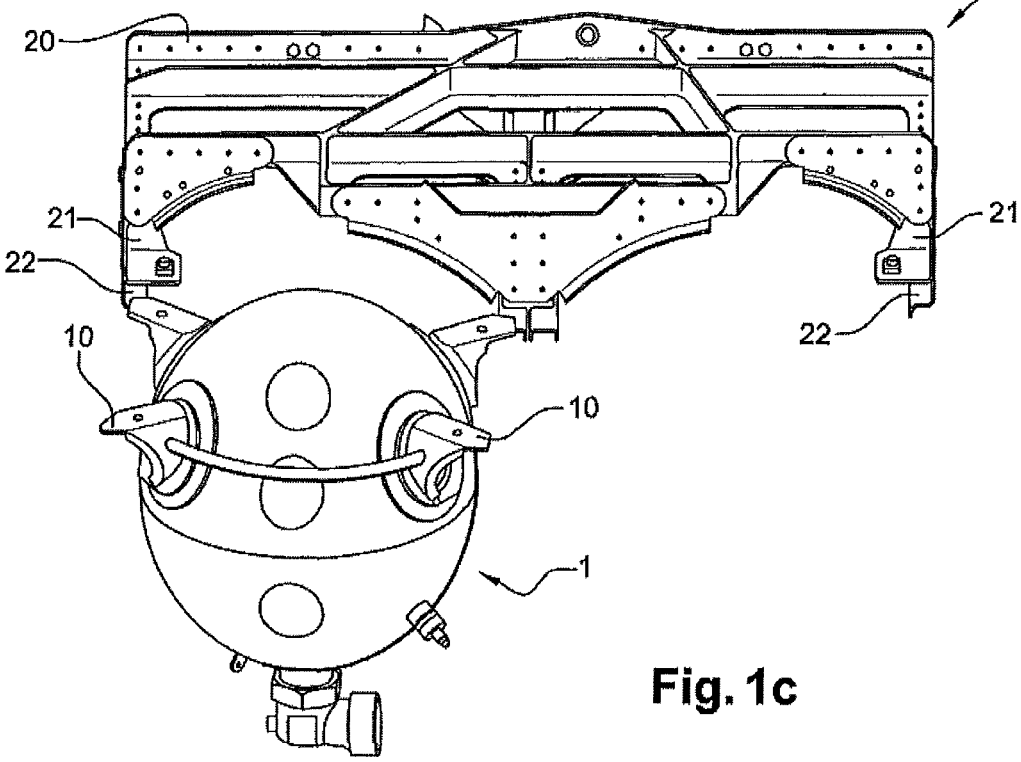
FIG. 1*c*: already cited, a schematic representation illustrating the installation of the reservoir of FIG. 1*a* in the hanger structure of FIG. 1*b*, FIG. 2*a*: a schematic representation of the front side of a reservoir according to a first embodiment of the disclosed embodiments.

The reservoir 3, for example, has four metal fittings 300 of the same type as the metal fittings of the reservoir 1 described with reference to FIG. 1*a*.

Each metal fitting 300 protrudes laterally from said upper spherical head, and has an upper bearing surface geometrically fitted to a lower bearing surface of a lower edge of a crossbar 42 on which said upper surface makes contact, with each reservoir 3 being attached to the lower edges of two adjacent crossbars 42. The fittings 300 and the crossbars have paired holes for the passage of fasteners of known type, not shown in the Figures.

More generally, other forms of fittings known to one skilled in the art can be combined with this embodiment of the means of suspension 31 and the carriers 41.

In another preferred embodiment, the means of suspension 31 of the reservoir 3 protrude vertically from the upper spherical head of the reservoir 3, and have a free end 31*b* in the form of a hook curved toward the back of the reservoir 3, with the free end 31*b* being located in a position essentially vertical from the center of gravity of the reservoir 3.

"Toward the back of the reservoir" means toward a side of said reservoir that is engaged first of all in the hanger structure 4 during its installation, opposite from a front side corresponding to the side by which an operator holds said reservoir, for example by means of handles 32.

Figure 3A:
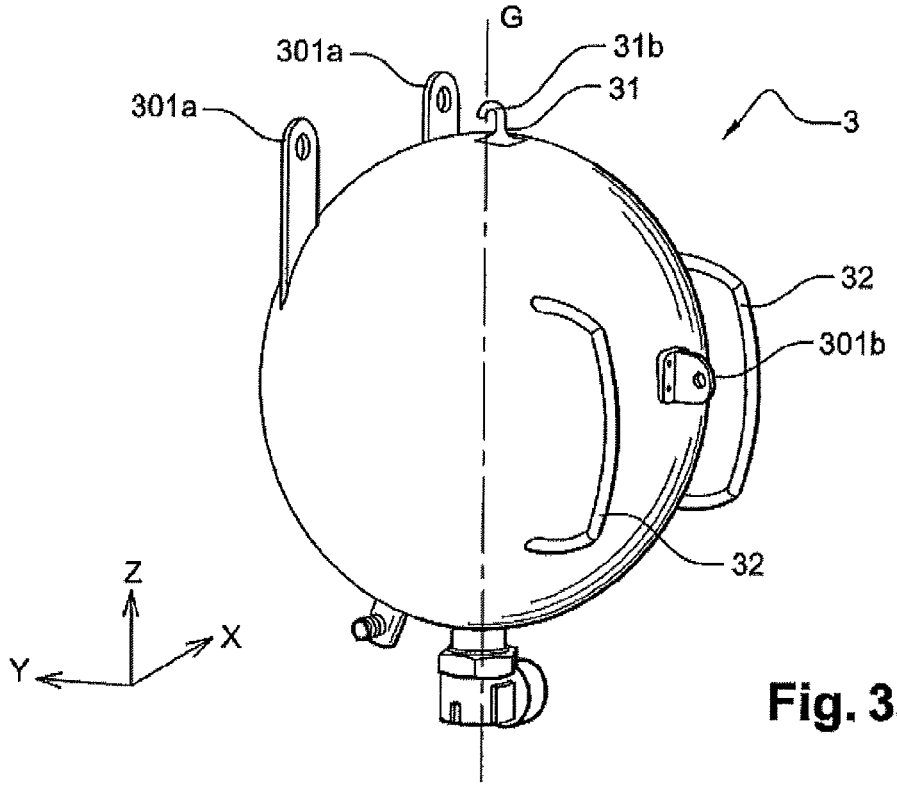
FIG. 3*a*: a schematic representation in perspective of a reservoir according to a second embodiment of the disclosed embodiments.

In the non-limiting example shown in FIG. 3*a*, the means of suspension 31 extend between an end integral with the upper spherical head of the reservoir and said free end 31*b* along the G axis.

The carriers 41 of the hanger structure 4 complementary to the means of suspension 31 have a free end 31*b* in the form of a hook, and in the example shown they have a ring 41*b* securely fastened beneath the chassis 40. In the non-limiting example shown in FIG. 3*b* and FIG. 3*c*, the ring 41*b* has a U shape.

Other shapes are feasible for the ring 41*b* as long as they are complementary to the hook shape of the free end 31*b* and permit the suspension of the reservoir 3 by engagement of said free end in said ring. The structural characteristics of the ring 41*b* and of the linkage of said ring with the chassis 40 are defined to assure sufficient mechanical strength to support the weight of the reservoir 3 filled with extinguishing agent and propelling agent.

The position of the ring 41*b* beneath the chassis is such that the intermediate position of the reservoir 3 corresponding to the position of said reservoir when it is suspended on said ring by its free hook-shaped end 31*b* is adjacent to the operational position.

The reservoir 3, for example, has one or more rear metal fittings 301*a* positioned on the back side of said reservoir, and one or more front metal fittings 301*b* on the front side of said reservoir, whose geometries do not obstruct the vertical motion of the reservoir 3 to engage or disengage the free hook-shaped end 31*b* in the ring 41*b*.

Figure 3B:
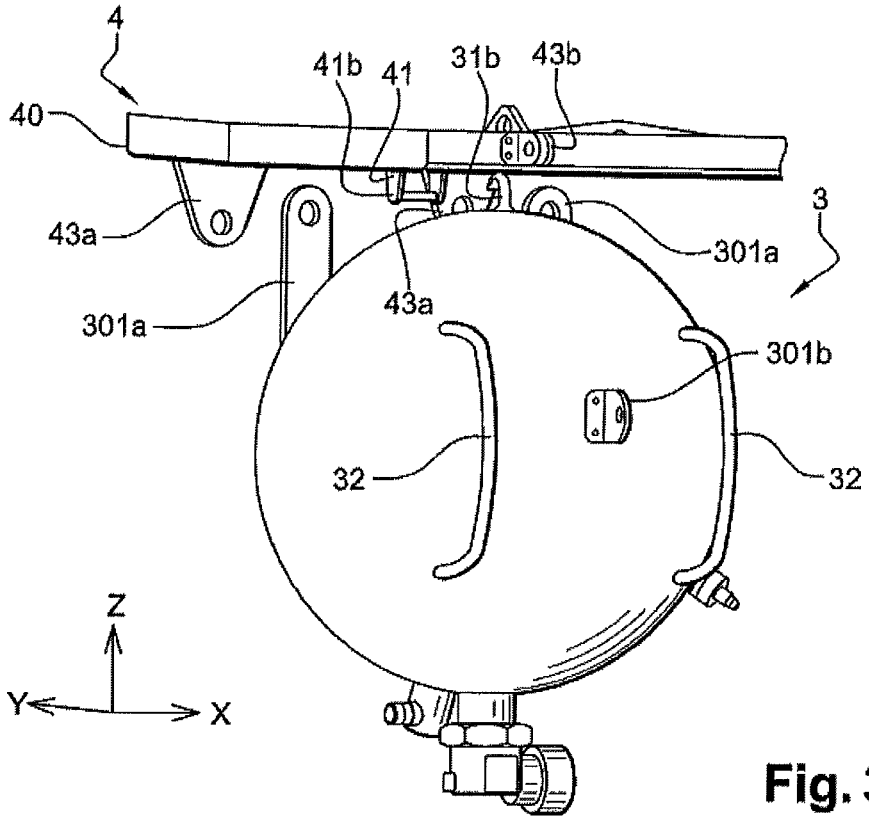
FIGS. 3*b* and 3*c*: two schematic representations in perspective, illustrating the installation of the reservoir of FIG. 3*a* in a hanger structure according to the disclosed embodiments.
Figure 3C:
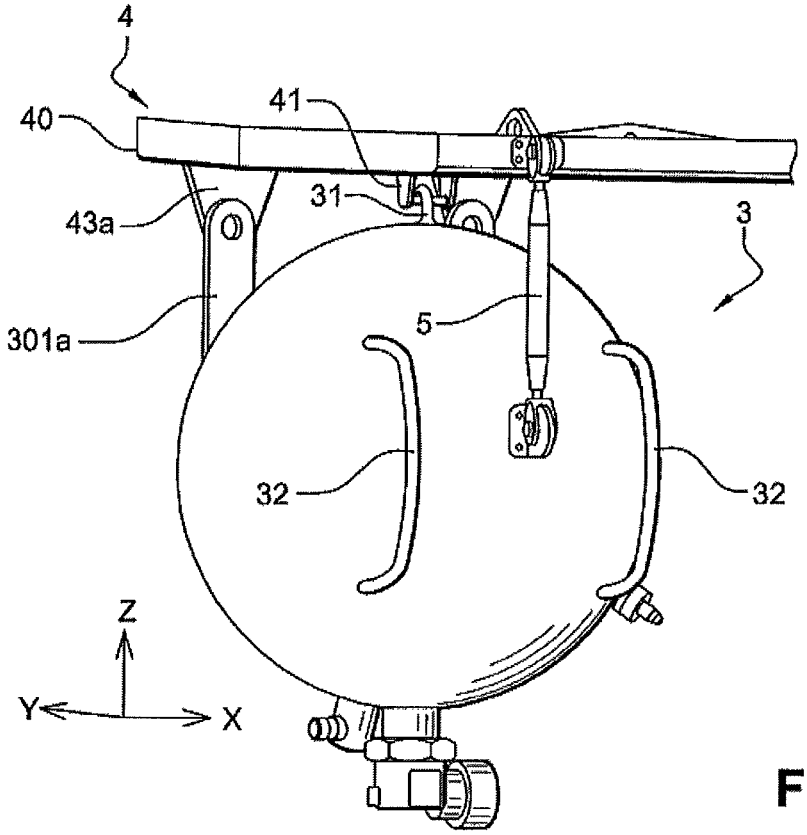

In the non-limiting example shown in FIGS. 3*b* and 3*c*, the reservoir 3 has two rear fittings 301*a* and one front fitting 301*b*. Each rear fitting 301*a* is in the form of a strap elongated upward, essentially parallel to the XZ plane, and has at least one hole for the passage of a fastener. The front fitting 301*b* forms a point of attachment for a first end of a connecting rod 5, and has at least one hole for the passage of a pin to hold said connecting rod.

The hanger structure 4 in this case has two rear points of attachment 43*a*, which are in the shape of straps essentially parallel to the XZ plane in the non-limiting example shown in FIGS. 3*b* and 3*c*, on which the rear metal fittings 301*a* of the reservoir 3 make contact, and a front point of attachment 43*b*, also in the form of a strap, to which is fastened a second end of the connecting rod 5. The rear and front points of attachment 43*a* and 43*b*, respectively, also have one or more holes for the passage of fasteners or holding pins.

This particular embodiment of the metal fittings 301*a*, 301*b*, and of the hanger structure 4, is beneficial in the case of a free hook-shaped end 31*b*, because said fittings do not obstruct the engagement and disengagement of said free end in the ring 41*b*. Fittings 300 of the type shown in FIGS. 2*a* to 2*c*, making contact horizontally with the hanger structure 4, are less advantageous since the engagement and disengagement of the free end 31*b* in the ring 41*b* necessitate placing the reservoir 3 in a superelevated position relative to the intermediate position, and such fittings 300 could interfere.

Other forms of metal fittings known to one skilled in the art can be combined with this embodiment of the means of suspension 31 and of the carriers 41.

More generally, the embodiments of the means of suspension 31 and of the carriers 41 are not limited to the preferred embodiments described. In accordance with the disclosed embodiments, the means of suspension 31 and the carriers 41 must be complementary and permit suspending the reservoir 3 from the hanger structure 4. It should be pointed out that because they are complementary, the forms of the means of suspension 31 and of the carriers 41 most often are interchangeable. For example, the carriers 41 can be in the form of a hook and the means of suspension 31 can be in ring form.

The embodiments in which the means of suspension 31 have a single free end are particularly advantageous because it is easier for an operator to adjust the position of a single free end relative to the carriers.

A method for suspending the reservoir 3 on a hanger structure 4 according to the disclosed embodiments comprises principally the following steps:

a) a step for suspending the reservoir 3 on the hanger structure 4, b) a step for fastening the reservoir 3 to the hanger structure 4.

During step a) for suspending the reservoir 3, the free end of the means of suspension 31 is engaged in the carriers 41 of the hanger structure 4, and said reservoir is suspended in an intermediate position adjacent to the intended operational position, in which the metal fittings 300, 301*a*, 301*b* of said reservoir are not put to work to hold the reservoir 3.

In the case of means of suspension 31 that have a free T-shaped end 31*a* that interacts with carriers 41 of the type of a longitudinal guide 41*a*, the intermediate position is obtained, after engagement of the free T-shaped end 31*a* in the guide 41, by moving the reservoir 3 longitudinally along the guide.

During step b) for fastening the reservoir 3, the axes of the different holes in the metal fittings 300, 301*a*, 301*b* of said reservoir and the corresponding holes in the hanger structure 4 are aligned to permit the passage of fasteners of known type. With the reservoir 3 held in the intermediate position, the fasteners can be put in place individually and then tightened progressively without the reservoir 3 being at risk of becoming unhooked.

When the axes of said holes are essentially vertical, as is the case, for example, in the example of the fittings 300 considered in the example shown in FIGS. 2*a* to 2*c*, the alignment is obtained while keeping the reservoir 3 suspended on the hanger structure 4.

When the axes of said holes are essentially horizontal, as is the case, for example, in the example of the fittings 301*a* considered in the example shown in FIGS. 3*a* to 3*c*, the alignment may necessitate a slight tilting of the reservoir 3 (superelevation of the order of a centimeter), which is then no longer suspended on the hanger structure 4.

When the fittings 300, 301*a*, 301*b* are fastened to the hanger structure 4 and the reservoir 3 is in its operational position, the means of suspension 31 of said reservoir are engaged without contact and are no longer mechanically working.

Removing a reservoir 3 fastened to a hanger structure 4 comprises a step during which the fasteners are withdrawn, so that said reservoir is in its intermediate position, and a step during which the reservoir 3 is withdrawn.

Because of the means of suspension 31 of the reservoir 3 and the carriers 41 of the hanger structure 4, said reservoir is placed adjacent to its operational position in said hanger structure with little effort, which in particular improves the convenience and safety conditions during the installation and removal of each reservoir 3, and may permit the installation and removal of each reservoir 3 by a single operator, where the reservoirs known to one skilled in the art might necessitate the presence of at least two operators.

The invention claimed is:

1. A fire extinguisher device for aircraft comprising:

a hanger structure and a reservoir of extinguishing agent, the reservoir being hung beneath said hanger structure by metal fittings extending from said reservoir selectively secured by fasteners to said hanger structure, the reservoir comprising a suspension element extending therefrom, the hanger structure comprising a carrier element configured to receive and support the suspension element, said suspension element and said carrier element being configured such that:

when the fasteners are tightened they clamp together the metal fittings and the hanger structure so that the reservoir is held in an operational position in which the metal fittings are integral with and mechanically support the reservoir from the hanger structure, and the suspension element and the carrier element are mechanically disengaged from contact with each other, and when the fasteners are withdrawn from the metal fittings, the reservoir moves to an intermediate position in which the metal fittings are free from the hanger structure and the reservoir is suspended and supported by mechanical interaction of the suspension element and the carrier element.

2. The device according to claim 1, wherein the suspension element is located in an upper part of the reservoir, essentially in a position vertical from a center of gravity of said reservoir.

3. The device according to claim 1, wherein the suspension element and the carrier element are made so that the intermediate position is adjacent to the operational position.

4. The device according to claim 1, wherein the suspension element has a free end in the form of a hook.

5. The device according to claim 4, wherein the carrier element comprises a ring.

6. The device according to claim 1, wherein the suspension element has only one free end.

7. The device according to claim 1, wherein the suspension element has a free end with a T-shaped cross section.

8. The device according to claim 1, wherein the carrier element comprises a longitudinal slide bar.

9. An aircraft that has at least one engine pylon in which at least one extinguishing device is fastened, the extinguishing device comprising:

a hanger structure and a reservoir of extinguishing agent, the reservoir being hung beneath said hanger structure by metal fittings extending from said reservoir selectively secured by fasteners to said hanger structure, the reservoir comprising a suspension element extending therefrom, the hanger structure comprising a carrier element configured to receive and support the suspension element, said suspension element and said carrier element being configured such that:

when the fasteners are tightened they clamp together the metal fittings and the hanger structure so that the reservoir is held in an operational position in which the metal fittings are integral with and mechanically support the reservoir from the hanger structure, and the suspension element and the carrier element are mechanically disengaged from contact with each other, and when the fasteners are withdrawn from the metal fittings, the reservoir moves to an intermediate position in which the metal fittings are free from the hanger structure and the reservoir is suspended and supported by mechanical interaction of the suspension element and the carrier element.

10. A method for fastening a reservoir of extinguishing agent for an extinguishing device comprising:

a hanger structure and a reservoir of extinguishing agent, the reservoir being hung beneath said hanger structure by metal fittings extending from said reservoir selectively secured by fasteners to said hanger structure, the reservoir comprising a suspension element extending therefrom, the hanger structure comprising a carrier element configured to receive and support the suspension element, said suspension element and said carrier element being configured such that:

when the fasteners are tightened they clamp together the metal fittings and the hanger structure so that the reservoir is held in an operational position in which the metal fittings are integral with and mechanically support the reservoir from the hanger structure, and the suspension element and the carrier element are mechanically disengaged from contact with each other, and when the fasteners are withdrawn from the metal fittings, the reservoir moves to an intermediate position in which the metal fittings are free from the hanger structure and the reservoir is suspended and supported by mechanical interaction of the suspension element and the carrier element, the method comprising the steps:

suspending the reservoir on the hanger structure during which the suspension element of the reservoir is engaged in the carrier element of the hanger structure and interacts with said carrier element so that the reservoir is in the intermediate suspended position in which the metal fittings are free, and fastening the reservoir beneath the hanger structure in which the fittings of said reservoir are fastened to said hanger structure by tightening the fasteners.

* * * * *